United States Patent [19]

Ikeda

[11] 4,308,686

[45] Jan. 5, 1982

[54] TOY HAVING APPENDAGE CAPABLE OF MOVING IN TWO DIRECTIONS

[75] Inventor: Masaki Ikeda, Tokyo, Japan

[73] Assignee: Tomy Kogyo Co., Inc., Tokyo, Japan

[21] Appl. No.: 151,435

[22] Filed: May 19, 1980

[30] Foreign Application Priority Data

Jun. 8, 1979 [JP] Japan ..... 54-78812[U]

[51] Int. Cl.[3] ..... A63H 13/02

[52] U.S. Cl. ..... 46/129; 46/92; 46/123; 46/265

[58] Field of Search ..... 46/92, 91, 129, 123, 46/265, 266, 145, 128, 127, 119, 118, 264

[56] References Cited

U.S. PATENT DOCUMENTS

| | | | |
|---|---|---|---|
| 224,375 | 2/1880 | Alexander | 46/129 |
| 753,109 | 2/1904 | Poppenhusen | 46/129 |
| 1,673,772 | 6/1928 | Middleton | 46/129 |
| 2,535,868 | 12/1950 | Roberts | 46/129 |
| 2,636,316 | 4/1953 | Solovioff | 46/92 |
| 3,452,473 | 7/1969 | Convertine | 46/129 X |
| 3,566,537 | 3/1971 | Tepper et al. | 46/265 |
| 3,798,830 | 3/1974 | Grieder | 46/92 |

FOREIGN PATENT DOCUMENTS

| | | | |
|---|---|---|---|
| 1097875 | 1/1961 | Fed. Rep. of Germany | 46/123 |
| 1016244 | 11/1952 | France | 46/129 |
| 20116 | of 1896 | United Kingdom | 46/92 |
| 313232 | 6/1929 | United Kingdom | 46/129 |

*Primary Examiner*—Hugh R. Chamblee
*Assistant Examiner*—Mickey Yu
*Attorney, Agent, or Firm*—K. H. Boswell; Edward D. O'Brian

[57] ABSTRACT

A toy which can repetitively move with respect to the medium supporting it has a toy body with at least one appendage movably mounted to the body. A portion of that appendage is exposed from the body and is positioned to contact the supporting medium. A mechanism within the body is operatively connected to the appendage for moving the appendage such that the portion of the appendage exposed from the body can move in a first direction at one velocity and a second direction at a different velocity. A portion of the mechanism moves with rotary motion which is transferred by another portion of the mechanism to cause still a further portion of the mechanism to move with linear motion. The portion of the mechanism moving with linear motion is operatively connected to the appendage to move the appendage.

13 Claims, 8 Drawing Figures

TOY HAVING APPENDAGE CAPABLE OF MOVING IN TWO DIRECTIONS

BACKGROUND OF THE INVENTION

A toy is described which has one or more appendages which contact the medium supporting the toy and move in a first direction at a slow velocity and then in a second direction at a rapid velocity to move the toy with respect to the supporting medium. The toy is continuously moved with respect to the medium by repetition of the movement of the appendages between the first and second directions.

The movement of frogs can be quite fascinating and a series of toys have been developed which attempt to mimic this movement. The frog is capable of moving both on land and in the water. Previous toys and associated devices such as fishing lures have mimicked either one or the other of these movements but not both.

For water movement, i.e., swimming, several toys and/or patents are known which imitate what is commonly referred to as the "frog kick". This movement is based on flexure of the frog's legs at its knees when the legs are brought forward followed by extensions of the frog's legs at its knees when the legs are brought backward for the propelling stroke. U.S. Pat. No. 3,798,830 describes such a frog. The legs are moved by the interaction of a crank pin with linking arms attaching to the inside ends of the frog's legs. The knees of the frog are freely pivotable within the limits of certain stop pins. Another aqueous frog is described U.S. Pat. No. 2,636,316 directed to a fishing lure. The legs of this frog do not simulate a frog kick but the propulsion mechanism is quite unique. It is based on a chemical tablet which reacts with water to produce a gas. The gas thus produced fills a chamber. When the chamber contains a sufficient quantity of gas it pivots upwardly within the body of the frog and the bell crank mechanism attached to the chamber pulls the hind legs forward via connecting rods extending between the bell crank and the pivotally mounted hind legs.

Several patents are known which describe frog-like toys capable of movement on solid surfaces. Included in these are U.S. Pat. No. 2,535,868 which utilizes elastic bands to move hinge plates on which the caricature of a frog is either stamped or reproduced. Another such frog described in U.S. Pat. No. 753,108 has both movable front and rear legs. A small spring motor drives several crank disks. Interacting with the crank disks is a trigger which is capable of inhibiting the disks from rotating in certain instances and allowing them to rotate in other instances. The action of the legs of the frog described in this patent propels it forward and when it lands the trigger is released which again propels the frog forward.

In U.S. Pat. No. 224,375 another such frog is described which utilizes a Pitman connecting between a crank attached to a spring motor and a lever arm attached to the legs to drive the frog. This frog incorporates a mechanism which locks the Pitman when the frog is originally set in an upright position but releases the Pitman if the frog is bumped or the like. U.S. Pat. No. 1,673,772 describes a toy frog which has a spring motor located inside which is movable within the interior of the frog. The hind legs of the frog are pivotally mounted to the motor housing via a shaft. Also located on the shaft are two levers. A spring is attached to one lever between it and the housing and a second lever interacts with a rotating cam disk. The second lever is replaced by the cam disk which tenses the spring and when the lever slips by the cam disk the spring causes the rear legs to propel the frog.

All of the above described toy frogs or fishing lures are capable of movement on land or water but are not uniquely designed to move in both. It is considered that because of the obvious utilitarian aspects with regard to play value of toy frogs, a toy frog which would be useable by a child either on a solid surface or in a body of water would be very desirable.

BRIEF SUMMARY OF THE INVENTION

In view of the above it is a broad object of this invention to provide a mechanism which is capable of propelling a toy on both a solid medium and a liquid medium. Additionally it is an object of this invention because it is directed toward a toy to provide a toy having a mechanism which is simple in construction and therefore economical to manufacture and durable in use.

These and other objects are achieved by a toy capable of making repetitive movements with respect to a medium supporting the toy which comprises: a toy body; at least one appendage movably mounted in said toy body, a portion of said appendage exposed from said toy body and positioned such that said portion of said appendage exposed from said toy body is capable of contacting said support medium; means located within said toy body and operatively connected to said appendage for moving said portions of said appendage exposed from said toy body at a first velocity in a first direction and at a different velocity in a different direction; said means including rotary means capable of rotary movement, linear means capable of linear movement, and interfacing means for converting said rotary movement into said linear movement; said linear means operatively connected to said appendage to move said appendage in said first direction and said different direction at said first velocity and said second velocity, respectively.

Preferably the toy body includes two appendages movably mounted in the toy body such that a portion of the appendages exposed out of the toy body moves in the same plane. These appendages preferably are rear appendages that are capable of moving forward at a slow velocity and rearward at a much higher velocity. The two different velocities of movement in the two different directions assist the toy in moving through a liquid medium.

Preferably the means within the toy body includes a housing having a crank disk rotatably mounted on it and at least one crank pin attached to the crank disk. A drive means is associated with the crank disk to rotate the crank disk. A sliding member is mounted on a housing. The sliding member slides on the surface of the housing back and forth between a first and second position. A biasing spring or other biasing means biases the sliding member toward the first position. The sliding member includes an engagement means which is engageable with the crank pin for a portion of the rotation of the crank disk through one revolution and disengageable with the crank pin for the remainder of the rotation through said one revolution. The sliding member is moved against the bias of the biasing means from the first position to the second position when the crank pin is engaged with the engagement means during said portion of the revolution of the crank disk wherein said engagement takes place and the sliding member is free to return from the second position to the first position when the engagement means disengages from the crank pin during the remainder of the revolution of the crank disk.

Preferably the engagement means only is positively engageable with the crank pin when the crank disk rotates in one direction. Rotation of the crank disk in the other direction does not result in transfer of movement to the sliding member via positive engagement of the engagement means with the crank pin. During rotation in this other direction there can be passive engagement of the engagement means with the crank pin which is not transferable into sliding motion of the sliding member.

Preferably said appendages are first class levers. However, it is not mandatory that said first class levers be straight only that they be pivotally mounted to the toy body at a point intermediate their ends. The placement of the pivot point is such that the length of the levers outside of the toy body is greater than that between the pivot point and the point wherein one end of the lever are operatively attached to the sliding member.

The engagement means preferably is an arm pivotally mounted on the sliding member and includes a biasing means which assists in maintaining it in its positive engagement position when the crank disk rotates in the first direction but allows it to be released from positive engagement with the crank pin when the crank disk moves in the other direction.

The drive means preferably is a spring motor including an appropriate gear train. Preferably a governor means is associated with the gear train for governing the speed of rotation of a shaft which connects the spring motor with the crank disk. A clutch means is utilized to disengage the gear train between the shaft and the governor when the crank disk and the shaft attached thereto are rotated in the other direction.

BRIEF DESCRIPTION OF THE DRAWINGS

This invention will be better understood when taken in conjunction with the drawings wherein.

Figure 2:
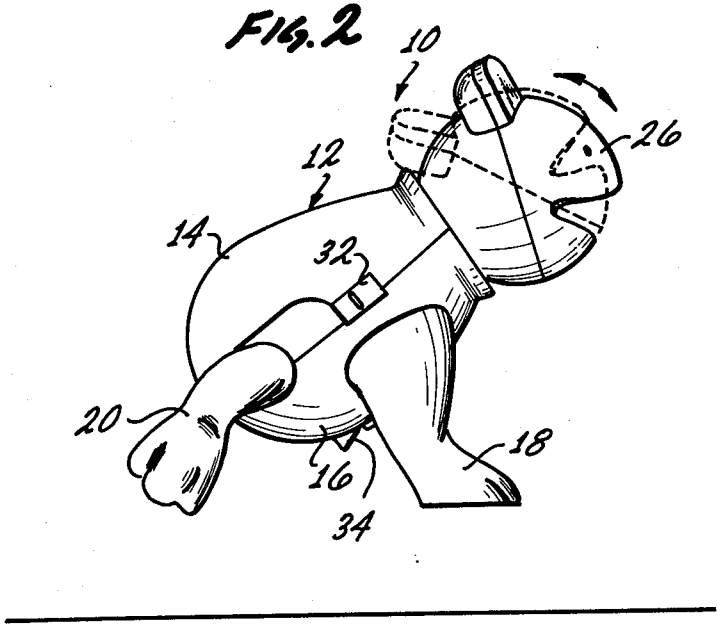
FIG. 2 is a side elevational view similar to FIG. 1 except the rear legs are in a second position, the toy is in a different position with respect to the support medium and alternate positions of the head of the toy are shown in solid and phantom lines, respectively.

The invention illustrated in the drawings and described in the specification encompasses certain principles and/or concepts as are set forth and defined in the claims appended to this specification. Those familiar with the toy arts will recognize that these principles and/or concepts could be utilized with a number of embodiments which are different from the exact embodiment described herein but which do not differ with respect to the principles and concepts defined by the claims. For these reasons this invention is to be construed in light of the claims and should not be considered as being limited to the exact embodiment herein described.

DETAILED DESCRIPTION

The toy 10 of the invention has a main body 12 which is defined by an upper body shell 14 and a lower body shell 16. Two front legs collectively identified by the numeral 18 project forward and two rear legs 20 and 22 project downwardly from the body 12. A small rubber pad collectively identified by the numeral 24 is located at the base of each of the rear legs 20 and 22. Head 26 rests on the upper portion of the body 12.

Figure 1:
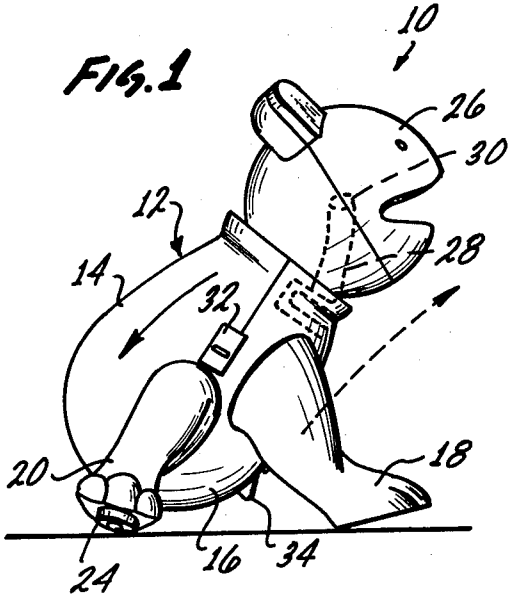
FIG. 1 is a side elevational view of the toy of the invention shown with the rear legs in one position and the toy positioned with respect to a support medium.

As seen in FIG. 1 the body 12 when it rests on its respective legs 18, 20 and 22 sits such that its longitudinal axis is at an oblique angle to a support surface. The rear legs 20 and 22 are capable of moving in a plane that is coplanar with the oblique longitudinal axis of the body 12. The movement of the rear legs 20 and 22 as hereinafter described in detail is such that the body 12 can be projected upwardly from the support surface such as is depicted in FIG. 2 simulating the hopping movement of a frog.

Located in the upper portion of the body 12 and projecting into the head 26 is head support member 28 seen in phantom lines in FIG. 1. The head 26 is pivotally mounted about axle 30 on head support member 28. This allows the head 26 to freely pivot back and forth such as is shown in FIG. 2 in solid and phantom lines. As the toy 10 moves the movement is transferred to the head 26 causing the head 26 to move with a nod-like motion.

Located along the seam line (not numbered) between the upper and lower body shells 14 and 16 is a switch 32. The switch 32 controls the motor (not numbered) of the toy 10 as hereinafter described. Located on the belly (not separately numbered) of the body 12 is a winding knob 34. The winding knob 34 is used to energize the spring motor (not numbered). After energizing which is usually done with the switch 32 in the "off" position the switch 32 is turned on and this activates the toy 10. The toy 10 slowly descends backward bringing its rear legs 20 and 22 upwardly toward the head 26. The legs 20 and 22 move together both within the plane described above. This allows the body 12 to move backward and downward until the toy 10 is in a position essentially depicted by FIG. 1. After a slight pause, the toy 10 then forcefully ejects the rear legs 20 and 22 downwardly within the above described plane such that they are in a position as essentially depicted in FIG. 2. This moves the toy 10 forward with respect to the support surface it's resting on causing the toy 10 to simulate a hopping motion. Concurrently the head 26 is free to swivel as described above. The toy 10 then comes to rest on all four of its legs 18, 20 and 22 and after another slight pause the rear legs 20 and 22 once again start pulling upwardly toward the head 26 causing the body 12 of the toy 10 to once again move toward the support surface. In this manner the toy 10 is able to simulate the terrestrial movement of a frog.

The toy 10 is also capable of movement in a fluid, typically water. When the rear legs 20 and 22 are pulled upwardly toward the head 26 this motion is done at a very slow velocity. As such if the toy 10 is floating in a body of water this slow velocity of movement of the rear legs 20 and 22 allows the legs 20 and 22 to move with very little fluid resistance in the water without moving the toy 10. When the rear legs 20 and 22 move backward away from the head 26, however, it is done at a second velocity much more rapid than the first. Because of the rapidity of this second velocity the legs 20 and 22 do not freely move within the water but are subjected to fluid resistance acting against them. This propels the toy 10 forward across the surface of the body of the fluid. The toy 10 is thus able to swim across the surface of a fluid medium by the slow velocity of the forward stroke coupled with the first velocity of the rearward stroke of its legs 20 and 22.

Within the interior of the body 12 is a housing 36. This housing 36 has a base plate 38 and cover 40. Located between the base plate 38 and cover 40 is a spring motor mechanism (not numbered as a collective unit, and for further reference in this specification the motor will be generally referred to without noting that it is not numbered). Attached to the housing 36 in a manner as hereinafter depicted are the rear legs 20 and 22. The housing 36 is fixedly held within the body 12 by the interaction of certain bosses and journals (not spearately numbered or shown in the drawing) but so placed on both the housing 36 and the body 12 to fixedly located the housing 36 within the body 12.

A main shaft 42 is appropriately journaled in both the base plate 38 and cover 40. The shaft 42 is square, however, at the point it goes through both the base plate 38 and the cover 40 appropriate round bearings (not shown or numbered) are attached to the shaft 42 to allow it to freely turn within both the base plate 38 and the cover 40. One end of the shaft 42 after exiting the cover 40 projects toward the lower shell 16. The winding knob 34 is fixedly attached to this end of the shaft 42. The shaft 42 thus can be rotated by manipulation of the winding knob 34 by the user of the toy 10. Located within the interior of the housing 36 next to the base plate 38 is a spur gear 44 which is fixedly attached to shaft 42 and rotates as shaft 42 rotates. A flat, spiral coil spring 46 is located between spur gear 44 and cover 40. One end of spring 46 is attached to shaft 42 and the other end is attached to base plate 38. As viewed in FIG. 6 clockwise rotation of winding knob 34 coils the spring 46 about the shaft 42 thus energizing the motor of the toy 10. When the spring 46 is allowed to uncoil it imparts a counterclockwise rotation (as viewed in FIG. 6) to shaft 42.

Figure 6:
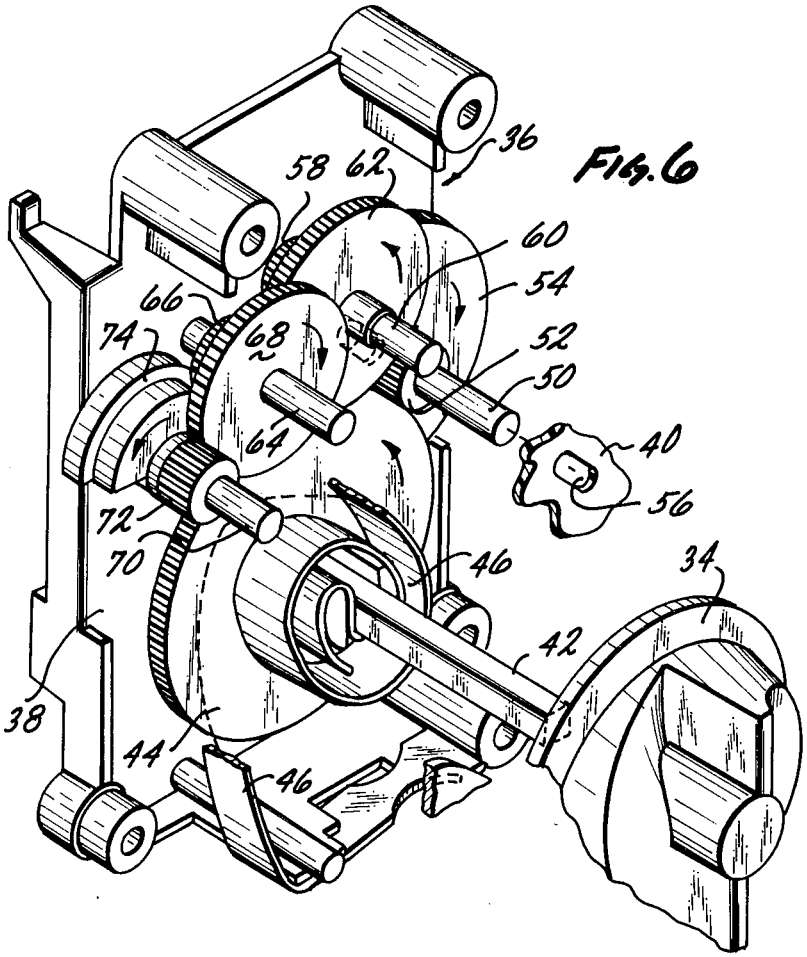
FIG. 6 is an isometric view in partial section and partially exploded of the underside of the components shown in FIGS. 3 and 4.

On the other end of shaft 42, opposite winding knob 34, is crank disk 48. Crank disk 48 is located on the surface of base plate 38 exterior the housing 36. In FIG. 6 crank disk 48 is thus hidden from view. However, it can be seen in FIGS. 3 and 4 lying on the surface of base plate 38. Crank disk 48 is fixedly attached to shaft 42 and turns with respect to rotation of shaft 42 directly regardless of whether shaft 42 is turning clockwise or counterclockwise. Crank disk 48 is utilized to transfer the energy of coil spring 46 to other components hereinafter described which cause the rear legs 20 and 22 to move to propel the toy 10.

Within the interior of housing 36 are several gears (separately numbered hereinafter) and a weighted hemi-disk (also numbered hereinafter) which serves as a clutch mechanism during winding of the winding knob 34, a speed governing mechanism for speed of rotation of the shaft 42 in response to energy imparted to it by spring 46 and as part of the mechanism controlling the off and on mode of the toy 10. For the purposes of this specification and in the interest of brevity certain bearing surfaces utilized to hold the gears and their appropriate axles in position within the housing 36 will not be described. These bearing surfaces are simply appropriate holes within the base plate 38 of the cover 40 sufficient to retain the appropriate axles in position.

One exception to the above outlined procedure with regard to the bearing exists in the way of mounting an axle 50. Axle 50 carries on it pinion 52 and spur gear 54. Pinion 52 and spur gear 54 are fixedly mounted to axle 50 such that rotation of one is accompanied by rotation of the other. Pinion 52 is positioned to engage spur gear 44. Axle 50 is mounted within a slotted bearing surface 56 is cover 40 as well as an identical bearing surface (not shown or numbered in base plate 38 and hereinafter referred to as "the other slotted bearing surface"). The slotted bearing surface 56 and the other slotted bearing surface allow axle 50 to move along a line which is essentially parallel to a line tangential to spur gear 44. At all times pinion 52 is meshed with spur gear 44. However, spur gear 54 moves into and out of engagement with a pinion 58 freely mounted on axle 60 as axle 50 moves within bearing surface 56 and other slotted bearing surface.

A spur gear 62 is fixedly mounted to shaft 60 along with pinion 58. This rotation of pinion 58 is transferred to spur gear 62. Adjacent to axle 60 is axle 64 which carries pinion 66 and spur gear 68. As with the other gears previously mentioned these two gears are fixedly attached to axle 64 and thus rotate as a unit. Spur gear 62 meshes with pinion 66 and thus rotation of axle 60 is transferred to axle 64. Mounted adjacent to axle 64 is axle 70. It carries a pinion 72 and a weight 74 shaped as a hemi-disk. Both the pinion 72 and the weight 74 are fixedly mounted to axle 70. Pinion 72 meshes with spur gear 68.

As viewed in FIG. 6 when spur gear 44 rotates counterclockwise this motion drives pinion 52 in a counterclockwise manner such that axle 50 is positioned in bearing surface 56 and the other slotted bearing surface in a manner which positions spur gear 54 in meshing contact with pinion 58. Counterclockwise rotation of spur gear 44 results in clockwise rotation of axle 50 and the gears mounted on it, counterclockwise rotation of axle 60 and the gears mounted on it, clockwise rotation of axle 64 and the gears mounted on it and counterclockwise rotation of axle 70 including counterclockwise rotation of weight 74. When spur gear 44 rotates clockwise, however, it rotates axle 50 counterclockwise moving axle 50 within bearing surface 56 and the other slotted bearing surface such that engagement between spur gear 54 and pinion 58 is broken. As such, axles 60, 64 and 70 and the gears and the weight 74 attached to them are not affected by the clockwise rotation of spur gear 44. The movement of axle 50 serves as a clutch mechanism. Clockwise rotation (as viewed in FIG. 6) of spur gear 44 happens when shaft 42 is turned by knob 34 to energize spring 46. Thus, during the energizing of spring 46 the motion throughout the chain of gears described above is broken and is not transferred to weight 74. However, when shaft 42 turns counterclockwise (as viewed in FIG. 6) under the influence of spring 46 the connection through the train of gears between spur gear 44 and weight 74 is completed. If weight 74 is inhibited from rotating, spur gear 44 and shaft 42 are likewise inhibited. This is utilized to effect an off-on control of the toy 10.

Figure 7:
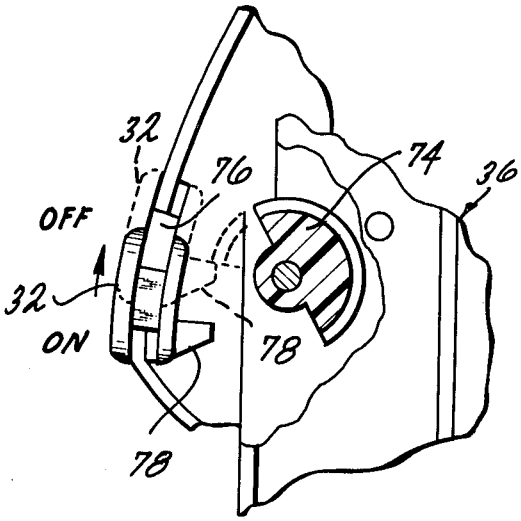
FIG. 7 is a bottom plan view of certain of the components shown in FIG. 6 on the left hand side and certain of the outside surfaces of the toy of FIG. 1.

Referring to FIG. 7 off-on switch 32 is free to slide between a first position shown in solid lines and a second position shown in phantom lines in a slot 76 formed between the upper and lower body shells 14 and 16. On the side of the switch 32 inside the body 12 there is located a small projection 78. Projection 78 is sized such that it is capable of interfering with the rotation of weight 74 when it is in a position as shown in phantom lines in FIG. 7. Prevention of rotation of weight 74 results in prevention of rotation of shaft 42 in a direction uncoiling or untensing spring 46. When the switch 32 is slid to the position shown in solid lines in FIG. 7 projection 78 is no longer positioned such that it is capable of interfering with the rotation of weight 74. The interaction of projection 78 with weight 74 serves to control the rotation of shaft 42 in the direction imparted to it by the uncoiling of spring 46 but the ability of axle 50 to move disconnecting the link between shaft 42 and weight 74 allows for rotation of shaft 42 in the other direction curling spring 46 to energize or tense it.

Figures 3, 5:
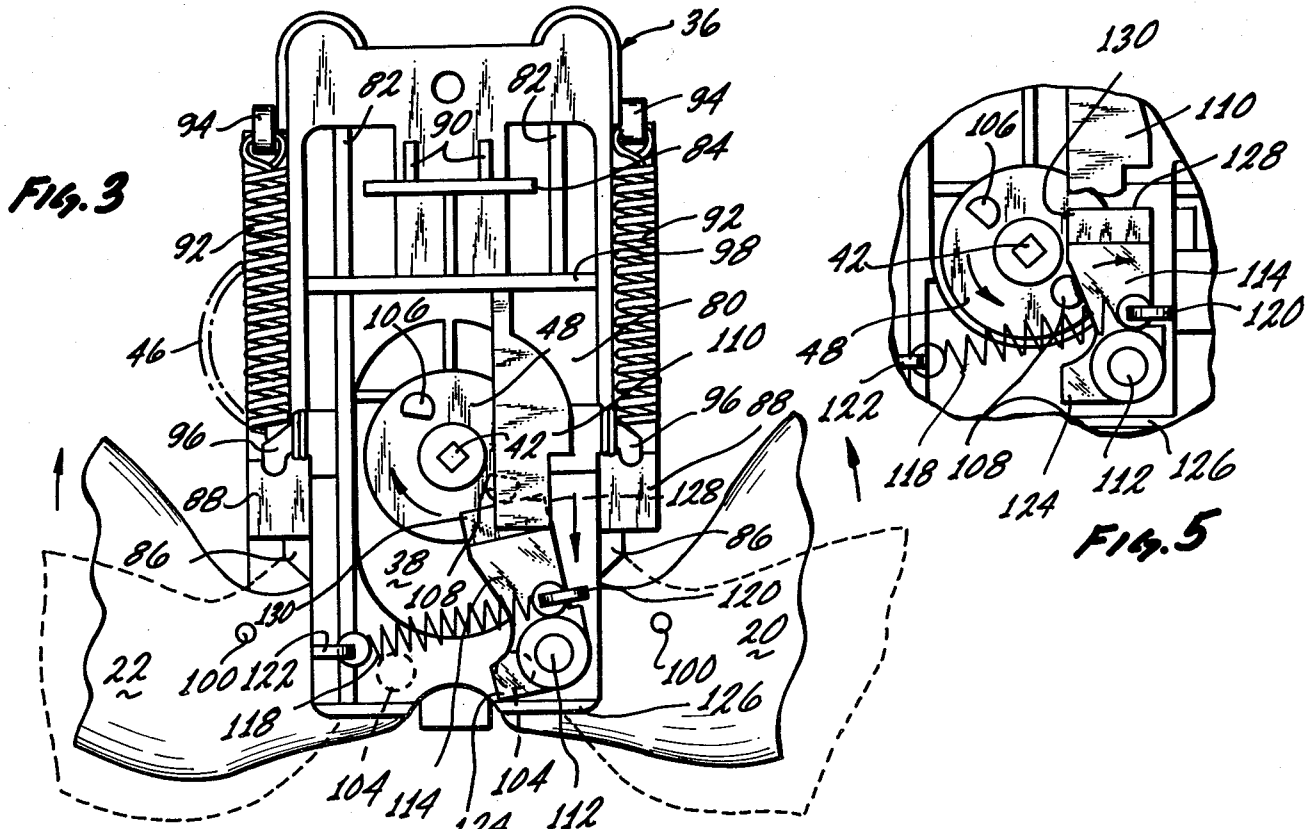
FIG. 3 is a top plan view of certain components located inside the body of the toy shown in FIG. 1.
FIG. 5 is a top plan view of a portion of those components shown in FIGS. 3 and 4 except these components are in a spatial relationship differing from that shown in both FIGS. 3 and 4.
Figures 4, 8:
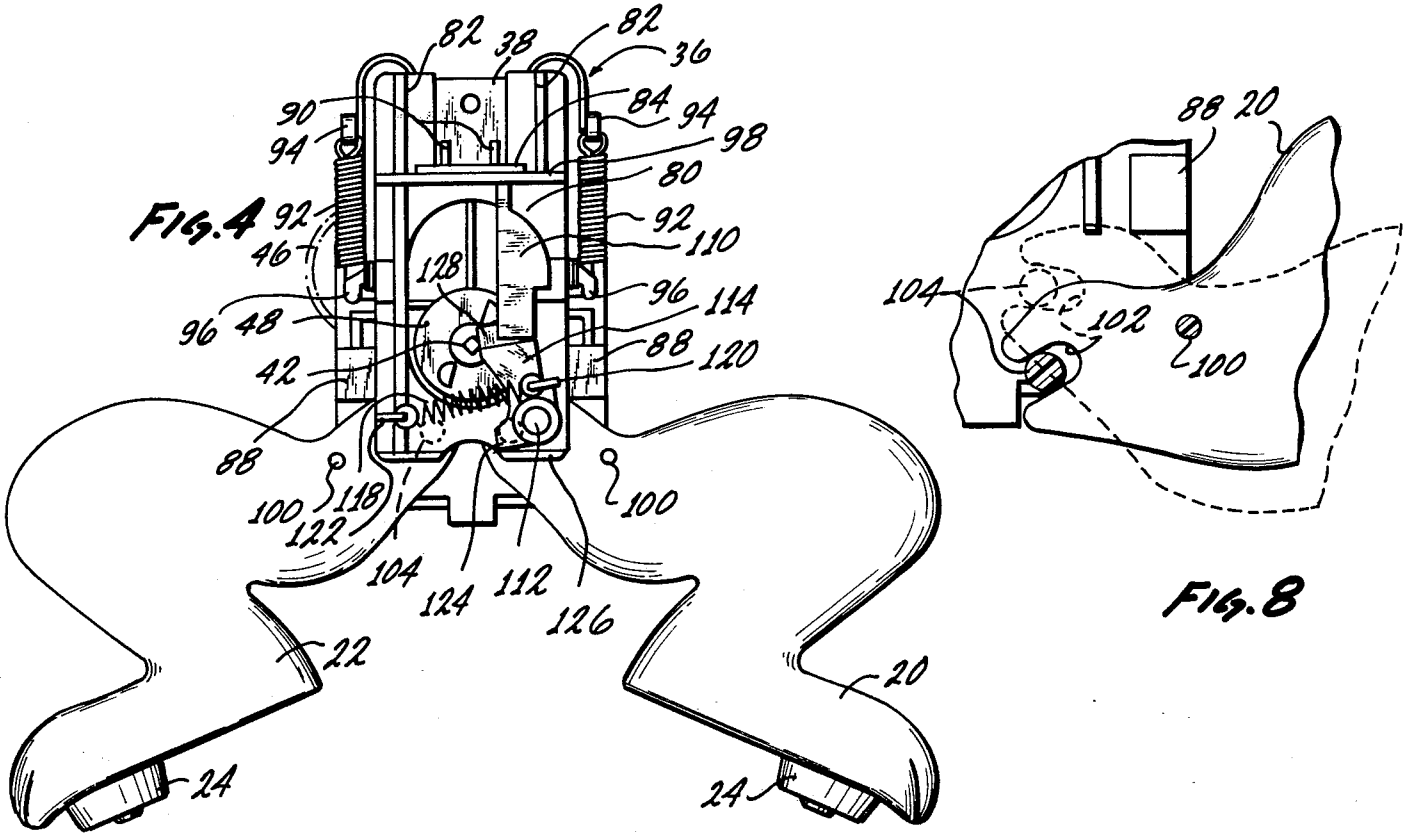
FIG. 4 is a top plan view similar to FIG. 3 except certain of the components are shown in a different spatial relationship than that shown in FIG. 3.
FIG. 8 is a plan view of a portion of FIG. 3 with certain overlying components removed to show the underneath components in two configurations, one in solid lines and one in phantom lines.

Referring now to FIGS. 3, 4 and 5 located on the outside of housing 36 is a complex shaped sliding member 80. Sliding member 80 is guided and restricted to a back and forth motion on the surface of base plate 38 by the interaction of certain of its parts with appropriate extensions of base plate 38. Two projections collectively identified by the numeral 82 extend from sliding member 80 and fit underneath a T shaped projection 84 formed with base plate 38. On both the right and left hand sides of sliding member 80 are feet collectively identified by the numeral 86 which fit underneath projections collectively identified by the numeral 88 formed with base plate 38. The two center posts collectively identified by the numeral 90 forming a part of projection 84 along with the positioning of the feet 86 within the interior of projections 88 prevent any side to side or rotational movement of sliding member 80 while allowing a back and forth (an up and down motion in the noted figures) movement of sliding member 80.

Identical springs 92 extend from between hooks 94 formed on the right and left hand side of base plate 38, respectively, and hooks 96 formed on the right and left side of sliding member 80, respectively. Springs 92 bias sliding member 80 upwardly as viewed in the noted figures. Its limit of travel is governed by abutment of edge 98 of sliding member 80 against projection 84 as is best seen in FIG. 4. Sliding member 80 would be free, as viewed in the noted figures, to slide downwardly except for its attachment to the base plate 38 by the springs 92.

Rear legs 20 and 22 are essentially first class levers. They are attached to base plate 38 by pins collectively identified by the numeral 100 passing through them and into the base plate 38. As is seen in FIG. 8 the inside end of rear leg 20 contains a slot 102. This slot 102 interacts with a pin 104 projecting downwardly from the bottom of sliding member 80. An identical attachment is utilized for the other rear leg 22 and thus like numbers are utilized where appropriate in the drawings. The legs 20 and 22 are effectively held in position against the housing 36 by locking the end containing the slot 102 between the sliding member 80 and the base plate 38.

As can be seen in FIG. 3 when the sliding member 80 is slid downwardly the legs 20 and 22 shown in solid lines are moved such that the inside ends of the leg go downwardly and the rest of the leg pivots about pins 100 such that the outside of the legs not shown in FIG. 3 move upwardly. When sliding member 80 is slid such that edge 98 is against projection 84 as shown in FIG. 4 the end of the legs wherein slots 102 are located is slid upwardly and the end of the legs which are positioned outside of the body 12 move downwardly. The position shown in FIG. 4 is identical to the position of a portion of the legs shown in phantom lines in FIG. 3. Movement of the legs about pins 100 is thus dependent upon movement of the sliding member 80. Both of the ends of each of the legs 20 and 22 as well as the point where pins 100 go through these legs 20 and 22 lie in the same plane. All movement of the legs 20 and 22 is within this plane. The pins 100 are closer to the ends of the legs 20 and 22 wherein the slots 102 are located. Thus the ends of the legs 20 and 22 external the body 12 move a greater distance than the ends wherein the slots 102 are located each time the legs 20 and 22 move.

As noted before crank disk 48 is fixedly attached to shaft 42 and rotates in response to it. Two crank pins 106 and 108 extend upwardly from the surface of crank disk 48. These crank pins 106 and 108 are rounded for the majority of their circumference but each has a flat edge. The function of this shape will be evident below. A portion of sliding member 80 located on the right hand side of crank disk 48 is raised such that it forms shelf 110. Shelf 110 is such that when crank disk 48 is rotated beneath it crank pins 106 and 108 are free to pass beneath the shelf 110 without touching it and therefore crank pins do not directly interact with sliding member 80.

Located on the lower right hand side of sliding member 80 is boss 112. Thus arm 114 is free to swivel arcuately about boss 112. A spring 118 stretches across between hook 120 located on arm 114 and hook 122 located on the lower left hand side of sliding member 80. As viewed in FIGS. 3 and 4 this biases arm 114 such that it rotates counterclockwise about boss 112. Its limit of rotation however is governed by interaction of corner 124 of arm 112 with ridge 126 on the lower part of sliding member 80. Counterclockwise rotation of shaft 42 as viewed in FIG. 6 is the same as clockwise rotation of shaft 42 as viewed in FIGS. 3, 4 and 5. As viewed in FIGS. 3, 4 and 5 shaft 42 rotates clockwise when spring 46 is decoiling or unwinding. As viewed in these figures shaft 42 is rotating counterclockwise when the spring 46 is being energized or coiled by turning winding knob 34.

Referring to FIG. 5 when the winding knob 34 is being turned this motion is transmitted directly to crank disk 48 because of its attachment onto shaft 42. The crank pins 106 and 108 are thus being rotated clockwise. Their flat surfaces (not numbered) strike arm 114 as is depicted in FIG. 5 and rotate arm 114 to the right about boss 112 against the bias of spring 118. As each one of these pins independently move past end 128 of arm 114 the arm returns to the left under the bias of spring 118; however, no other motion is communicated by the crank pins 106 and 108 to the arm 114 or the sliding member 80.

When, as viewed in FIGS. 3, 4 and 5, the crank disk 48 is rotating clockwise a different situation is presented. Clockwise rotation of the crank disk 48 brings the rounded portion (not numbered) of the crank pins 106 and 108 directly against the end 128 of the arm 114. This forces the arm 114 all the way to the left, i.e. counterclockwise; (it is in this position anyway, however, because of the tension of spring 118). Since the arm 114 cannot move any further in a counterclockwise direction, rotation of the crank disk 48 results in the crank pins 106 and 108 depressing the arm 114 downwardly. Since arm 114 is attached to sliding member 80 by the interaction of bearing 116 with boss 112 this motion is transferred to sliding member 80 depressing it or sliding it downwardly. As sliding member 80 slides downward it stretches springs 92 tensing them. The legs 20 and 22 meanwhile are simultaneously moving slowly such that their outside ends (the end of each of them which is external the body 12) is slowly moving toward the head 26.

When the crank disk 48 is in a position wherein one of the crank pins 106 or 108 is in a six o'clock position the corner 130 of the end 128 of arm 114 slips off of one of the crank pins 106 or 108 as the crank pin 106 or 108 involved continues its travel toward a seven o'clock position. When this happens sliding member 80 is free to very rapidly slide under the tension of springs 92, upwardly as viewed in the figures, until edge 98 abuts against projection 84. This results in a very rapid movement of the outside end of rear legs 20 and 22 in a direction away from head 26. The downward (as viewed in the figures) motion of sliding member 80, however, is much slower and is governed by the movement of crank pin 106 against the end 128 of arm 114.

In FIG. 4 crank pin 106 is just starting to engage end 128. It can be seen that it is essentially in a one o'clock position when this happens. This engagement continues as crank disk 48 rotates clockwise (as viewed in this figure) until crank pin 106 is in the six o'clock position wherein it releases from its engagement with arm 114. If the rotation of each of the crank pins 106 or 108 is considered independently, the sliding member 80 moves for only a portion of each rotation of crank disk 48, this portion being movement of the pin involved between the 1 o'clock position and the six o'clock position. Since there are two pins, however, the sliding member 80 moves twice for each rotation of the crank disk 48.

The speed of rotation of shaft 42 and as such crank disk 48 attached to it is governed by the fact that weight 74 is shaped as a hemi-disk. It will be remembered that weight 74 is spinning when shaft 42 is turning counterclockwise as viewed in FIG. 6 or clockwise as viewed in FIGS. 3 and 4. Thus the weight 74 is spinning when crank pins 106 and 108 are interacting with arm 114. Because of the asymmetrical shape of the weight 74 with respect to rotation of axle 70 it effectively governs the speed of rotation of axle 70 and all of the other components which in turn are a part of the gear train.

Axle 70 is limited as to its maximum speed of rotation because of the asymmetry of weight 74. As weight 74 starts to spin faster and faster it imparts vibration to axle 70. The ultimate speed of rotation of axle 70 is governed by the amount of force applied to it through the train of gears based on the strength of spring 46 and the actual weight of weight 74. The weight of weight 74 is appropriately chosen to allow the gear train and ultimately shaft 42 to turn at a speed allowing for slow movement of crank disk 48 and thus sliding member 80 and rear legs 20 and 22. When the arm 114 clears either crank pin 106 or 108 as those pins move past corner 130 of arm 114 the sliding member 80 and the legs 20 and 22 are allowed to rapidly move under the bias of spring 92. The legs are thus given one velocity when they move in one direction by the springs 92 and a different velocity when they move in the other direction by the force imparted to them via the components linking crank pins 106 and 108 with coil spring 46.

I claim:

1. A toy capable of making repetitive movements with respect to a medium supporting the toy which comprises:

a toy body;

at least one appendage movably mounted in said toy body, a portion of said appendage exposed from said toy body and positioned such that said portion of said appendage exposed from said toy body is capable of contacting said support medium;

means located within said toy body and operatively connected to said appendage for moving said portions of said appendage exposed from said toy body at a first velocity in a first direction and at a different velocity in a different direction;

said means including rotary means capable of rotary movement, linear means capable of linear movement, and interfacing means for converting said rotary movement into said linear movement;

said interfacing means including an engagement means pivotly mounted on said linear means, said engagement means reversibly engagable with said rotary means between a positive engagement position wherein rotary movement of said rotary means in one of a clockwise or counterclockwise direction is converted into linear movement of said linear means and a passive position wherein rotary movement of said rotary means in the other of said clockwise or counterclockwise direction is not converted into linear movement of said linear means;

said linear means operatively connected to said appendage to move said appendage in said first direction and said different direction at said first velocity and said different velocity, respectively.

2. The toy of claim 1 including:

two appendages movably mounted in said toy body such that both appendages move within the same plane, a portion of each of said appendages exposed from said toy body and positioned such that said portion of each of said appendages is capable of contacting said support medium, said portion of each of said appendages exposed from said toy body movable with respect to one another in said plane.

3. The toy of claim 1 wherein:

said means includes a housing;

a crank disk rotatably attached to said housing and including at least one crank pin located on said crank disk;

drive means associated with said crank disk for rotating said crank disk and said crank pin with respect to said housing;

a sliding member slidably mounted on a surface of said housing and located in association with said crank disk, biasing means attaching between said sliding member and said housing to bias said sliding member from a second position toward a first position;

said engagement means mounted on said sliding member, said engagement means engageable with said crank pin for a portion of one revolution of travel of said crank disk and disengageable with said crank pin for the remainder of said one revolution of travel of said crank disk, said slidable member sliding against the bias of said bias means from said first position to said second position at a first velocity during said engagement of said engagement means and said crank pin and said sliding member sliding under the influence of said biasing means from said second position to said first position at a second velocity during the disengagement of said engagement means and said crank pin.

4. The toy of claim 3 wherein:

said engagement means is operatively capable of said engagement with said crank pin when said crank disk rotates in said one of said clockwise or counterclockwise directions and said engagement means is capable of disengaging with said crank pin when said crank disk rotates in the other of said clockwise or counterclockwise directions such that rotary movement of said crank disk is transferred into linear movement of said sliding member when said crank disk rotates in said one of said clockwise or counterclockwise directions and said rotary movement of said crank disk is not transferred to said sliding member when said crank disk rotates in said other of said clockwise or counterclockwise directions.

5. The toy of claim 4 including:

two appendages movably mounted in said toy body such that both appendages move within the same plane, a portion of each of said appendages exposed from said toy body and positioned such that said portion of each of said appendages is capable of contacting said support medium, said portion of each of said appendages exposed from said toy body movable with respect to one another in said plane.

6. A toy capable of making repetitive movements with respect to a medium supporting the toy which comprises:

a toy body;

at least one appendage movably mounted in said toy body, a portion of said appendage exposed from said toy body and positioned such that said portion of said appendage exposed from said toy body is capable of contacting said support medium;

means located within said toy body and operatively connected to said appendage for moving said portions of said appendage exposed from said toy body at a first velocity in a first direction and at a different velocity in a different direction;

said means including rotary means capable of rotary movement, linear means capable of linear movement, and interfacing means for converting said rotary movement into said linear movement;

said linear means operatively connected to said appendage to move said appendage in said first direction and said different direction at said first velocity and said different velocity, respectively;

said means includes a housing;

a crank disk rotatably attached to said housing and including at least one crank pin located on said crank disk;

drive means associated with said crank disk for rotating said crank disk and said crank pin with respect to said housing;

a sliding member slidably mounted on a surface of said housing and located in association with said crank disk, biasing means attaching between said sliding member and said housing to bias said sliding member from a second position toward a first position;

said sliding member including an engagement means, said engagement means engagable with said crank pin for a portion of one revolution of travel of said crank disk and disengagable with said crank pin for the remainder of said one revolution of travel of said crank disk, said slidable member sliding against the bias of said bias means from said first position to said second position at a first velocity during said engagement of said engagement means and said crank pin and said sliding member sliding under the influence of said biasing means from said second position to said first position at a second velocity during the disengagement of said engagement means and said crank pin;

said engagement means is operatively capable of said engagement with said crank pin when said crank disk rotates in a first direction and said engagement means is capable of disengaging with said crank pin when said crank disk rotates in the opposite direction such that rotary movement of said crank disk is transferred into linear movement of said sliding member when said crank disk rotates in said first direction and said rotary movement of said crank disk is not transferred to said sliding member when said crank disk rotates in said opposite direction;

two appendages movably mounted in said toy body such that both appendages move within the same plane, a portion of each of said appendages exposed from said toy body and positioned such that said portion of each of said appendages is capable of contacting said support medium, said portion of each of said appendages exposed from said toy body movable with respect to one another in said plane;

each of said appendages comprises a lever attaching to said toy body and operatively associated with said sliding member such that said movement of said sliding member is transferred to said lever.

7. The toy of claim 6 wherein:

said levers constitute first class levers pivotally mounted to said toy body and having a first end operatively attached to said sliding member and a second end extending away from said toy body, the length of said levers between said first end and the point wherein said levers pivotally mount to said toy body being less than the length of said levers between their second ends and the point wherein said levers are pivotally attached to said toy body such that said second ends move through a greater distance than said first ends in response to movement of said levers by said sliding member.

8. The toy of claim 7 wherein:

said engagement means comprises an arm pivotally mounted to said sliding member, said arm capable of pivoting on said sliding member between a positive engagement position wherein said crank pin can positively engage said arm and convert rotary motion of said crank disk in said first direction into sliding motion of said sliding member and a nonoperative position wherein said crank pin only passively engages with said arm and is incapable of converting rotary motion of said crank disk in said other direction into sliding motion of said sliding member.

9. The toy of claim 8 including:

an arm biasing means biasing said arm toward said positive engagement position and capable of releasing said arm against the bias of said biasing means from said positive engagement position to said passive position when said crank disk rotates in said other direction.

10. The toy of claim 9 wherein:

said drive means includes a shaft located in said housing, gear train means operatively connected to said shaft and propulsion means operatively connected to said shaft;

said crank disk fixedly attached to said shaft and rotatable with respect to rotation of said shaft;

said propulsion means capable of rotating said shaft in said first direction.

11. The toy of claim 10 including:

governor means operatively associated with said gear means for governing the speed of rotation of said gear means and said shaft.

12. The toy of claim 11 including:

switch means operatively associated with said governor means for allowing or preventing rotation of said shaft;

said gear means including clutch means for disconnecting rotation of said governor means from rotation of said shaft when said shaft is rotated in said other direction and establishing rotation of said governor means with said shaft when said shaft is rotated in said first direction.

13. The toy of claim 12 wherein:

said propulsion means comprises a spring connecting to said shaft and capable of being coiled about said shaft when said shaft is rotated in said other direction and of uncoiling to turn said shaft in said first direction.

* * * * *